US006836983B2

(12) United States Patent
Pallas Moreno et al.

(10) Patent No.: US 6,836,983 B2
(45) Date of Patent: Jan. 4, 2005

(54) DEVICE FOR THE COUPLING OF EXCAVATOR TEETH

(75) Inventors: Jorge Pallas Moreno, El Masnou (ES); Javier Pueyo Molina, Barlelona (ES); Fermin Sanchez Guisado, Premia De Mar (ES); Jose Lopez Almendros, Barcelona (ES)

(73) Assignee: Metalogenia S.A., Barcelona (ES)

( * ) Notice: Subject to any disclaimer, the term of this patent is extended or adjusted under 35 U.S.C. 154(b) by 51 days.

(21) Appl. No.: 10/245,783

(22) Filed: Sep. 16, 2002

(65) Prior Publication Data

US 2003/0110668 A1 Jun. 19, 2003

Related U.S. Application Data

(63) Continuation of application No. 09/701,235, filed as application No. PCT/ES99/00160 on Jun. 3, 1999.

(30) Foreign Application Priority Data

Jun. 8, 1998 (ES) ..... 9801257

(51) Int. Cl.[7] ..... E02F 9/28
(52) U.S. Cl. ..... 37/452
(58) Field of Search ..... 37/454, 452, 449; 172/753, 772, 772.5; 403/375, 379.2, 379.4

(56) References Cited

U.S. PATENT DOCUMENTS 247,148 A * 9/1881 Anderson
1,775,984 A 9/1930 Younie
2,050,014 A * 8/1936 Morrison ..... 37/454
2,435,846 A * 2/1948 Robertson ..... 37/454
2,483,032 A 9/1949 Baer (List continued on next page.)

FOREIGN PATENT DOCUMENTS

| | | |
|---|---|---|
| EP | 1 096 073 A1 | 2/2001 |
| ES | 2077412 | 11/1995 |
| ES | 2146174 A | 7/2000 |
| GB | 1272955 | 5/1972 |
| WO | WO 92/19822 A1 | 12/1992 |
| WO | WO 00/01897 A1 * | 1/2000 |

*Primary Examiner*—Victor Batson
(74) *Attorney, Agent, or Firm*—Sughrue Mion, PLLC

(57) ABSTRACT

The device is characterized in that the nose of the tooth-carrier has a general structure in which two end regions thereof, one corresponding to the area of junction of the said nose with the body of the tooth-carrier and the other to the free end of the tooth-carrier, assume in cross-section a dovetail structure, the dovetail at the first end region being inverted compared to the dovetail at the second end region, the cross-section of the end projection of the nose of the tooth-carrier being constant and the upper face of junction of the said projection with the base of the tooth-carrier assuming a curved structure with the convexity directed outwards, the lateral faces of the nose of the tooth-carrier assuming a structure of flat facets, one of them carrying in proximity to the junction with the body of the tooth-carrier a substantially vertical indentation for the coupling of the retaining cotter pin.

11 Claims, 4 Drawing Sheets

U.S. PATENT DOCUMENTS 2,921,937 A * 1/1960 Opsahl ..... 37/454
3,117,386 A * 1/1964 Ferwerda ..... 37/454
3,496,658 A 2/1970 Eyolfson
3,520,224 A 7/1970 Hensley et al.
3,574,962 A * 4/1971 Smith ..... 37/454
3,839,805 A 10/1974 Stepe
3,919,792 A 11/1975 Hahn et al.
4,182,058 A 1/1980 Poncin
4,192,089 A 3/1980 Schwappach
4,404,760 A 9/1983 Hahn et al.
4,414,764 A 11/1983 Johansson et al.
4,625,439 A 12/1986 Johansson et al.
4,727,663 A 3/1988 Hahn
4,799,823 A * 1/1989 Williams ..... 405/180
4,811,505 A 3/1989 Emrich
4,965,945 A * 10/1990 Emrich
5,068,986 A 12/1991 Jones
5,088,214 A 2/1992 Jones
5,325,615 A 7/1994 Hutchins et al.
5,386,653 A 2/1995 Cornelius
5,423,138 A 6/1995 Livesay et al.
5,456,029 A 10/1995 Cornelius
5,469,648 A 11/1995 Jones et al.
5,502,905 A * 4/1996 Cornelius et al. ..... 37/460
5,561,925 A 10/1996 Livesay
5,617,655 A 4/1997 Launder et al.
5,653,048 A 8/1997 Jones et al.
5,765,301 A 6/1998 Clendenning
5,778,570 A * 7/1998 Eichelberger ..... 37/450
5,802,752 A 9/1998 Quarfordt
5,918,391 A 7/1999 Vinas Peya
5,987,787 A * 11/1999 Mack ..... 37/456
6,030,143 A 2/2000 Kreitzberg
6,047,487 A 4/2000 Clendenning
6,240,663 B1 6/2001 Robinson
6,321,471 B2 11/2001 Fernandez Munoz et al.
6,477,796 B1 * 11/2002 Cornelius
2001/0001352 A1 * 5/2001 Fernandez Munoz et al.

* cited by examiner

I-I

II-II

III-III

IV-IV

V-V

VI-VI

VII-VII

VIII-VIII

IX-IX

DEVICE FOR THE COUPLING OF EXCAVATOR TEETH

SPECIFICATION

This is a continuation of application Ser. No. 09/701,235, filed Nov. 22, 2000 which is a 371 of PCT/ES99/00160 filed Jun. 3, 1999. Each of these prior applications is hereby incorporated herein by reference, in its entirety.

The present invention refers to a device for the coupling of excavator teeth which is applicable to the buckets of excavating machines and, in general, to the active working edges of earth-moving machines of similar types.

Machines for civil engineering work which effect the removal of materials such as earth, rocks, etc., generally have active edges on the so-called buckets of the excavators, which are open receptacles of specific shape fixed to the supporting and travelling gear of the machine and which have the function of removing the mass of earth or earth and more or less loose stones, by means of their front edge, collecting in the bucket the materials which have been loosened, allowing them to be transferred to a vehicle for their transport to another site or simply for depositing the mass of earth and stones which has been removed, for its subsequent replacement, for example, in the case of the opening of a trench.

The buckets of excavators and the like suffer significant problems at the active edge because of the high degree of wear to which it is subjected by contact with the earth and stones, which have very abrasive characteristics. For this reason, it is necessary to equip the active edge of the excavator or similar machine with detachable teeth, which are removable components which bear the greater part of the wear by being in direct contact with the mass of earth and stones, and which are therefore parts which wear out very quickly. Said teeth, which are parts that can be exchanged fairly frequently, must combine characteristics which are to a certain extent contradictory, owing to the fact that, being parts which are changed frequently on excavating machines and the like, their price should be relatively low, so it is necessary to exclude mechanization of the teeth, which should be manufactured simply by casting or forging high strength steel. The other contradictory characteristic lies in the need for the mounting of the tooth on the tooth-carrier located at the active edge of the bucket for excavators or the like to be effected with sufficient adjustment to avoid as far as possible any play between the facing regions of the tooth-carrier and the tooth, since the occurrence, otherwise inevitable, of play in the said region results in an increase in the stresses at specific points of contact between the tooth and the tooth-carrier, which further increase the wear locally, in a process which may end in breakage of the parts and which involves changing the worn part, that is to say, the tooth, more or less frequently, according to how the above mentioned wear phenomena can be controlled to a greater or lesser degree.

At present, many types of coupling between the teeth of excavators and the tooth-carriers are known, although all of them, given the contradictory conditions to be fulfilled and the hard work to which said components are subjected, exhibit defects with regard to what could be considered an ideal solution in terms of life of the tooth and avoidance of excessive wear on the tooth-carrier, enabling the latter to have an acceptably extended life.

U.S. Pat. No. 5,561,925 refers to a tooth assembly and retaining mechanism in which a nose portion matching with the socket of the tooth has parallel surfaces interconnected by a flat end surface.

U.S. Pat. No. 4,625,439 refers to an excavating tooth retaining means comprising a nose portion in which the tooth is fixed by means of a wedge in which the wear part lands directly against the holder.

However, none of said patents discloses the double inverted dovetail structure which characterizes the present invention.

In order to obtain an improvement in the characteristics of the couplings for excavator teeth, achieving rapidity of assembly and secure and durable coupling between the tooth and the tooth-carrier, the inventor of the present patent application has carried out investigations and tests which have resulted in a coupling for excavator teeth which has an improved performance in use.

The coupling for excavator teeth and the like which is the subject of the invention is of the type which has a projection on the front face of the tooth-carrier, directed substantially axially with respect to the longitudinal axis of the tooth-carrier, and in which the cross-section of the tooth coupling region has a cross-section decreasing from the starting region to the free end, being characterized by the combination of the areas of contact between the tooth-carrier and the tooth, and the positioning of the retaining cotter pin, so that a close coupling is obtained between the tooth and the tooth-carrier, giving rise to secure fastening, with many areas of contact between the two coupled components, for the purpose of reducing the local wear and with an arrangement of angles of the areas of contact such that the stresses produced on the tooth tend to produce greater wedging and matching of the tooth with the tooth-carrier. In order to obtain this result, the area coupling the tooth with the tooth-carrier has a structure which is constituted basically by the joining of two reverse dovetail profiles, that is to say, the dovetail at the first end region being inverted compared to the dovetail at the second end region, corresponding to the starting region and the free end or point of the so-called "nose" of the tooth-carrier respectively. This is complemented by a slightly convex structure, above all of the upper area of junction between the base or start of the nose of the tooth-carrier and the end or projection thereof which has a uniform section. The area of junction of the upper curved part of the nose of the tooth-carrier with the base thereof has a narrow flat transverse region. The lateral faces of the nose of the tooth-carrier assume the form of facets, one of them corresponding to the front projection of constant section and another to the lateral faces, which may be flat or gently curved with the convexity towards the outside.

With this arrangement the result is obtained that the nose of the tooth-carrier exhibits a much higher mechanical strength and, above all, in normal operation thereof no stresses are produced which tend to eject the tooth, which constitutes a recurrent problem of the currently known tooth-carriers. In particular, the slightly curved structure, with the convexity directed outwards, of the upper face of the nose of the tooth-carrier permits, in addition to a very efficient coupling between the tooth and the tooth-carrier, an increase in the cross-section of the nose of the tooth-carrier, and therefore a greater mechanical strength on the latter.

The device of the present invention is likewise characterized by a new type of cotter pin for retaining the tooth on the tooth-carrier, which is distinguished by its easy introduction and high resistance to removal, basically comprising a body of the cotter pin of flattened generally parallelepipedal structure, which on one of its intermediate sized faces has a wide rebate to which there is joined, by means of vulcanization of a special rubber, an insert carrying a small lateral projection with rounded transverse edges which is intended to be introduced into a seating of complementary shape of the tooth-carrier after its introduction.

For greater understanding there are appended, by way of explanatory but non-limiting example, drawings of a preferred embodiment of the present invention.

Figure 12:
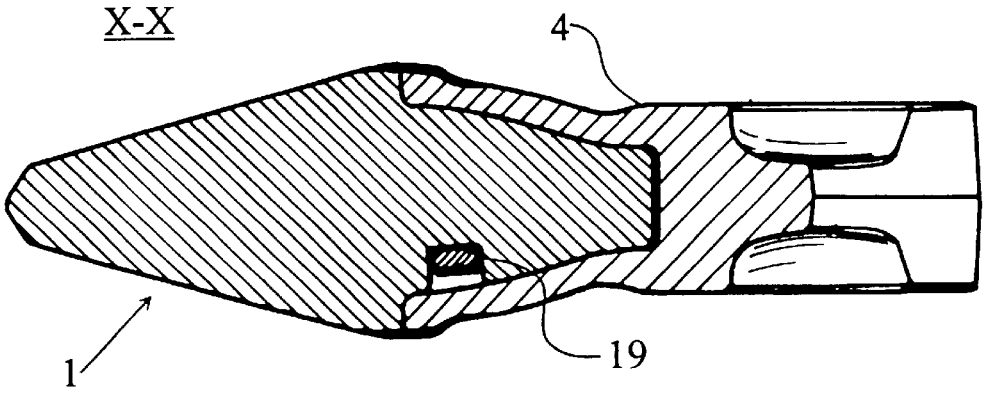
FIGS. 12 and 13 are respective sections through the section planes indicated.
Figure 14:
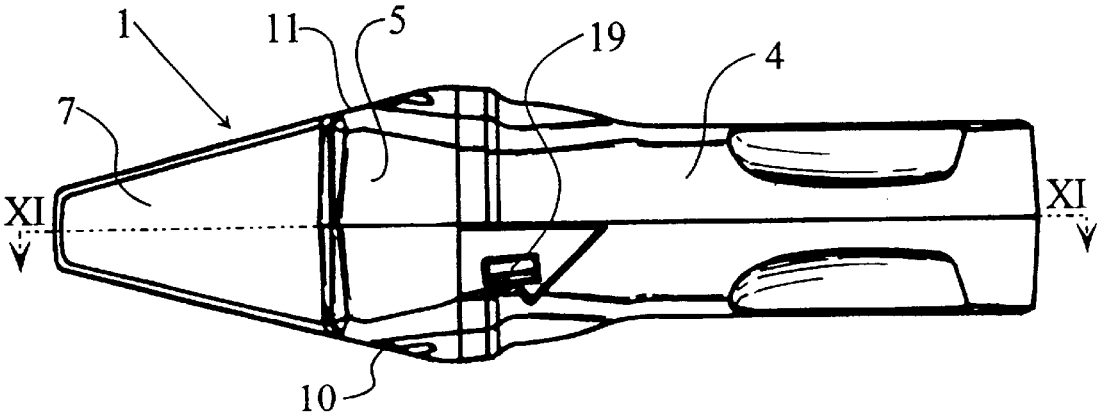
FIG. 14 is a plan view of the assembly of tooth and tooth-carrier.
Figure 15:
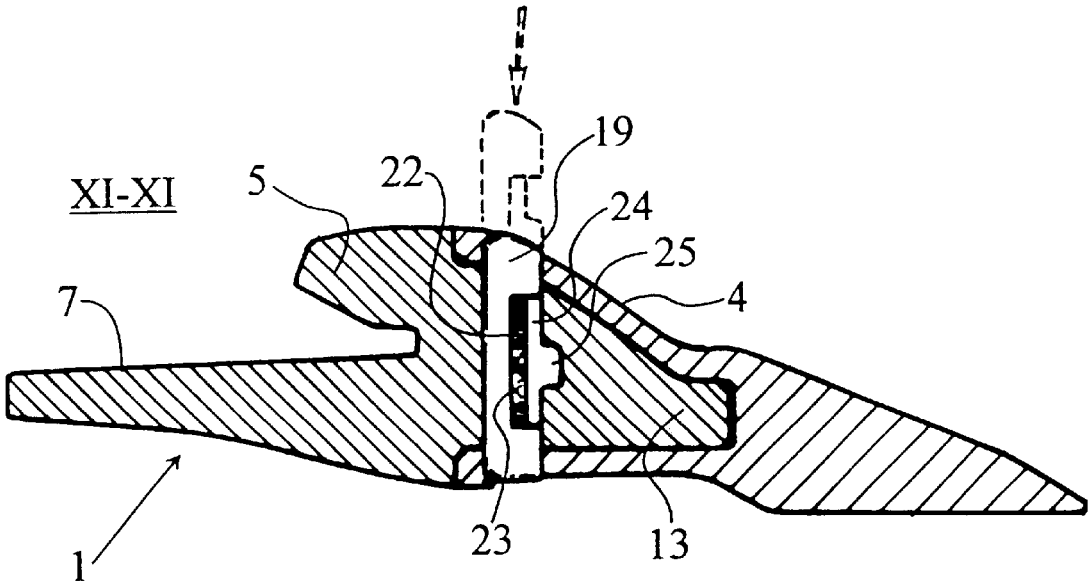
FIG. 15 is a longitudinal section in a vertical plane of the assembly of tooth and tooth-carrier as indicated.
Figure 16:
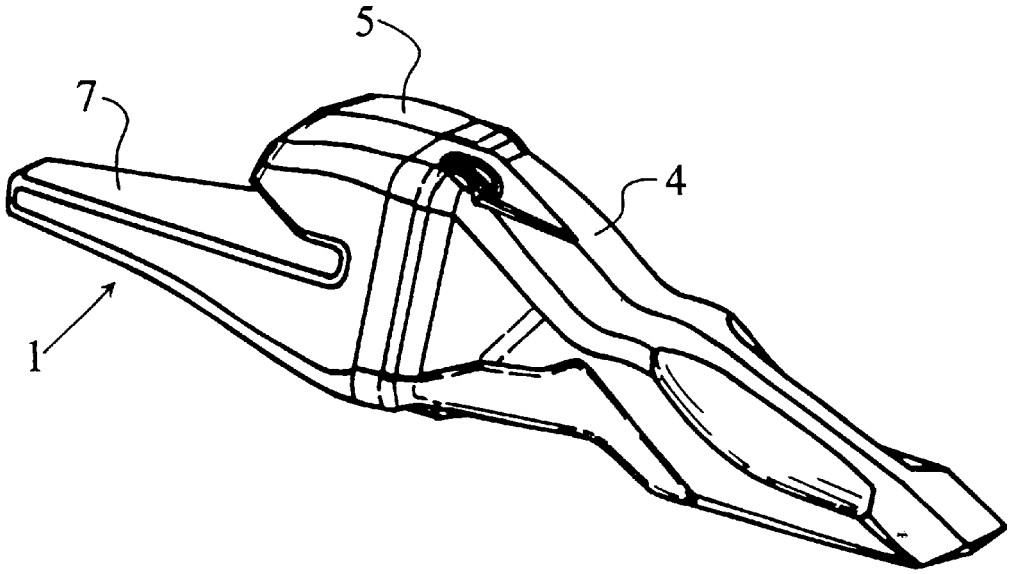
FIG. 16 is a perspective view of the assembly of tooth and tooth-carrier when assembled.

As shown in the Figures, the coupling for excavator teeth which is the subject of the present invention has a fork-like part 1 intended for coupling with the edge of the excavator bucket and a region 2 that projects from the rear face 3 of the region 1 and is intended to receive the excavator tooth, indicated by 4 in FIGS. 12 and 14 and in FIGS. 15 and 16.

Figure 1:
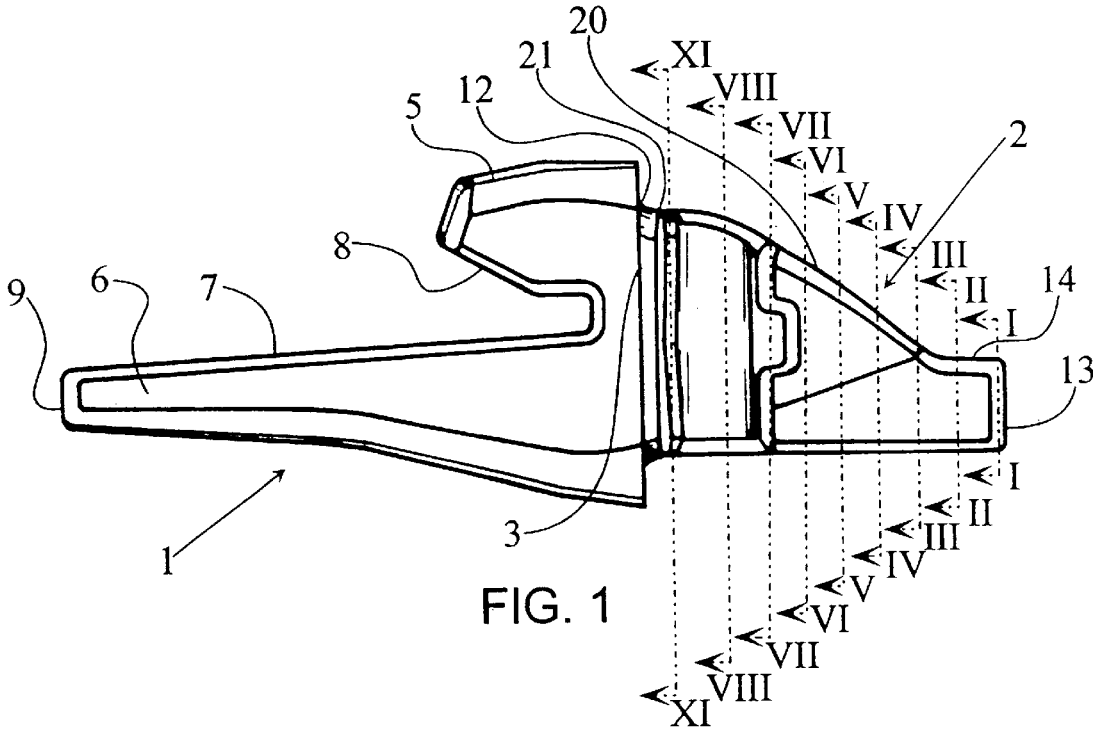
FIGS. 1 and 2 are views in elevation and in plan, respectively, of a tooth-carrier produced according to the present invention.
Figure 2:
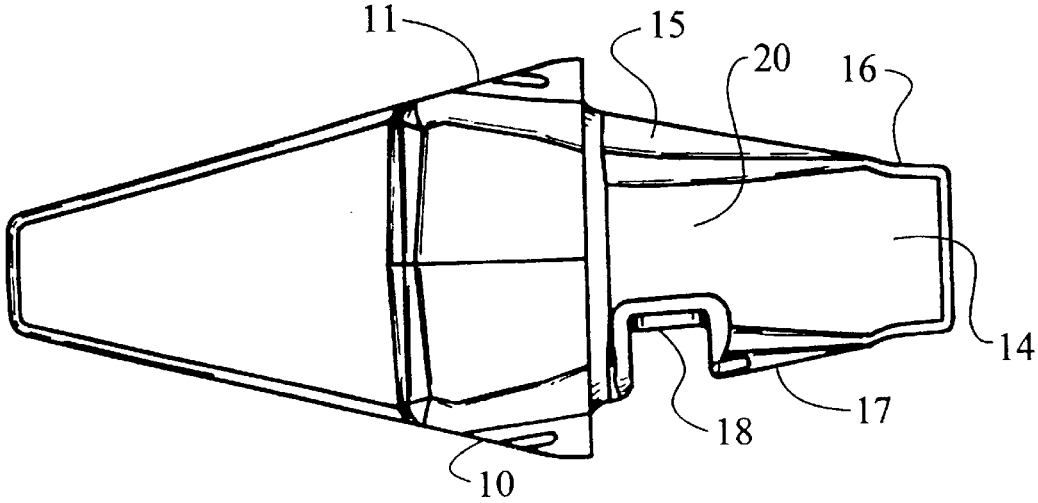
Figure 3:
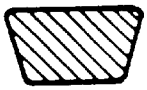
FIGS. 3 to 11 are sectional views through the section planes indicated in FIG. 1.
Figure 4:
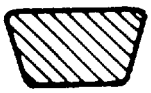
Figure 5:
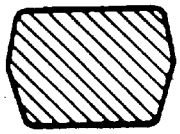
Figure 6:
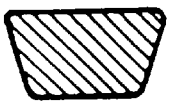
Figure 7:
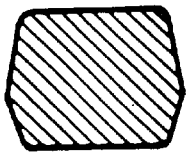
Figure 8:
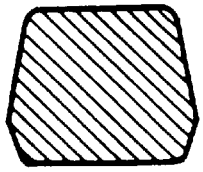
Figure 9:
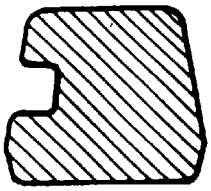
Figure 10:
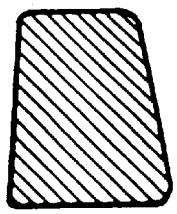
Figure 11:
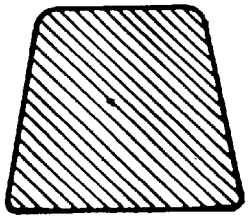
Figure 13:
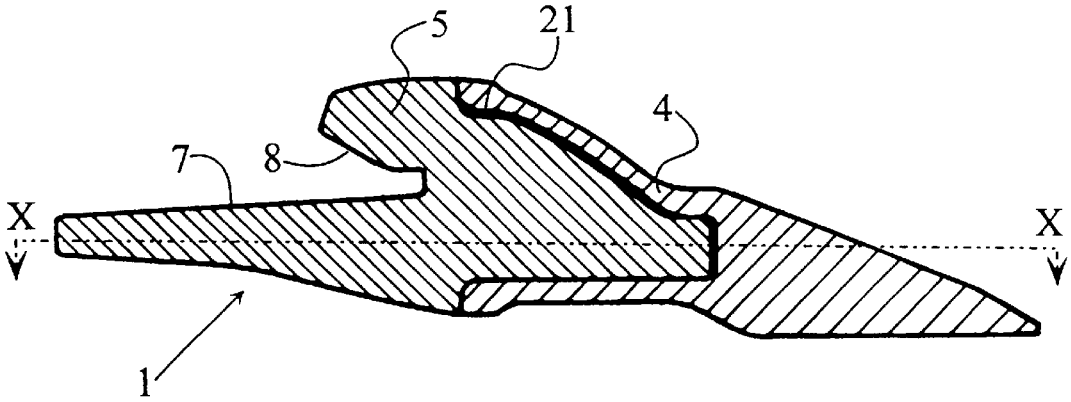

The upper face 20 of the nose of the tooth-carrier has a generally curved shape with the convexity directed outwards, joining the inner end of the projection 14 to the body 1 of the tooth-carrier by means of a small flat area in the area of junction with the said body indicated by 21 in FIG. 1 and also in FIG. 13.

The lateral faces 15 and 17 may be flat or curved, with the convexity directed outwards.

The construction of the nose of the tooth-carrier with the shape indicated makes it possible to obtain a much higher strength thereon, at the same time eliminating the reactions of ejection of the tooth which customarily occur in the currently known mountings for excavator teeth.

As will he observed in FIGS. 12 and 15, the cotter pin 19 has a flattened straight, generally parallelepipedal structure, having on one of its minor sides a wide indentation 22 in which, by means of a vulcanized coating 23, there is effected the joining of a straight insert 24, carrying a lateral projection 25, provided with rounded edges, which is engaged in a recess of complementary shape of the nose of the tooth-carrier.

This arrangement of the cotter pin therefore makes possible both its easy introduction by axial compression in its groove and sufficient retention thereof in the nose of the tooth-carrier. Withdrawal is also facilitated by the existence of the joining part of vulcanized rubber.

By means of the arrangement which has been explained, the coupling device for excavator teeth which is the subject of the present invention makes it possible to fit the tooth with minimum play in all the coupling areas, as well as allowing numerous areas of contact in order to reduce local wear, and reduces the force components in the direction of ejection of the tooth with respect to the tooth-carrier.

As it is obvious, this invention will cover the tooth holder as well as the tooth to be adapted to the same, which will have a form which is conjugated to the form of the mating tube holder, with cavities to receive the coupling device.

The characteristics of the cotter pin are also very advantageous, both as regards the ease of assembly and disassembly of the cotter pin and as regards the high holding force thereof.

What is claimed is:

1. A tooth for connecting to a projecting portion of a tooth carrier comprising:

a cavity having a top, a bottom, a mouth and an inner end, said cavity decreasing in cross-sectional area from said mouth to said inner end, wherein said tooth cavity is configured to receive the projecting portion, said mouth and said inner end comprising:

a parallel trapezoid in cross section, each having a long parallel side and a short parallel side, wherein said long parallel side of said mouth is disposed on said bottom of said cavity and said long parallel side of said inner end is disposed on said top of said cavity.

2. The tooth according to claim 1, wherein the distance between said long parallel side and said short parallel side of said mouth is larger than the distance between said long parallel side and said short parallel side of said inner end.

3. The tooth according to claim 2, wherein said top of said cavity defines an upper plane and said short parallel side of said mouth extends to said upper plane.

4. The tooth according to claim 3, wherein said bottom of said cavity defines a lower plane and said long parallel side of said mouth extends to said lower plane, and said short parallel side of said inner end extends to said lower plane.

5. The tooth according to claim 4, wherein said cross section of said cavity remains substantially constant at said inner end.

6. The tooth according to claim 5, wherein said cavity further comprises:

an upper face connecting said short parallel side of said mouth to said long parallel side of said inner end, said upper face having a convex shape.

7. The tooth according to claim 6, wherein said cavity further comprises:

a lower face connecting said long parallel side of said mouth to said short parallel side of said inner end, said lower face having a substantially flat shape.

8. The tooth according to claim 7, wherein said cavity further comprises:

a plurality of lateral sides each having a substantially flat surface sloping from said mouth to said inner end.

9. The tooth according to claim 1, wherein said trapezoidal cross section of said mouth and said trapezoidal cross section of said inner end are taken in separate planes that are orthogonal to a longitudinal axis of the tooth.

10. The tooth according to claim 1, wherein said cavity includes a transition portion between said mouth and said inner end, said transition portion having a six sided cross section defined by two trapezoids sharing a same side, the same side being a longer parallel side of each trapezoid.

11. The tooth according to claim 1, wherein said cavity includes a bottom end portion extending a length from said inner portion to an intermediate position between said inner portion and said mouth, said bottom end portion having a constant cross section throughout the length of the bottom portion.

* * * * *